US005746538A

United States Patent [19]

Gunness

[11] Patent Number: 5,746,538

[45] Date of Patent: May 5, 1998

[54] CONCRETE BARRIER HAVING A PLASTIC CLADDING

[76] Inventor: Clark Robert Gunness, 120 Morse Hill Rd., Newbury, N.H. 03255

[21] Appl. No.: 724,419

[22] Filed: Oct. 1, 1996

[51] Int. Cl.[6] ..... E01F 13/02

[52] U.S. Cl. ..... 404/6; 256/13.1

[58] Field of Search ..... 256/1, 13.1, 19; 404/6, 7, 9, 14

[56] References Cited

U.S. PATENT DOCUMENTS 3,678,815 7/1972 Younker ..... 404/6 X
4,307,973 12/1981 Glaesener ..... 404/6
4,348,133 9/1982 Trent et al. ..... 404/6
4,496,264 1/1985 Casey ..... 404/6
4,978,245 12/1990 White ..... 404/6

*Primary Examiner*—James Lisehora
*Attorney, Agent, or Firm*—William B. Ritchie

[57] ABSTRACT

A concrete barrier having a plastic cladding that provides protection for the concrete against chemical deterioration. A cap assembly enables the barrier to be fitted with standard anchor sheets and made in standard jersey barrier forms. The cap assembly has a large radius so that anchor sheets can be easily bent and will fit snugly within the form to prevent wet concrete from leaking between the anchor sheet and the form. The invention can be used with all standard jersey barrier forms, both horizontal and upside-down type, for either full or half barriers.

15 Claims, 7 Drawing Sheets

CONCRETE BARRIER HAVING A PLASTIC CLADDING

BACKGROUND OF THE INVENTION

1. Field of the Invention

The invention relates to concrete road barriers, particularly, road barriers conforming to the New Jersey barrier profile.

2. Description of the Related Art

Concrete is the most versatile and available building material on earth. It is inexpensive and very strong when applied with steel reinforcement, prestressing or post tensioning. Mighty bridges, skyscrapers, tunnels, road systems and barriers made from concrete can withstand natural forces so that these structures can last for many years.

As the highway system continued to develop and change, the need for a versatile temporary/permanent road barrier became evident. As a result, many systems were tried. Over the years, the style of barrier that has received the greatest success has been the so called "New Jersey" barrier (hereinafter jersey barrier). The jersey barrier has become almost as ubiquitous on the highways as road signs. Whether being used for a temporary road divider for a construction site or permanently separating traffic lanes on a bridge or overpass, the apparatus of choice is usually the jersey barrier.

A jersey barrier is typically fabricated from steel reinforced concrete that has been molded in a steel form. The typical profile has a narrow flat top, concave sides extending down to a wide base. The angle between the flat top and concave sides is about 90 degrees. A typical barrier weighs about 8,000 pounds. Consequently, shipment to a job site is usually limited to about 400 miles from the point of production in order to be cost effective.

As a result of the wide spread acceptance of this design and the need to have many suppliers due to transportation problems, a substantial investment in steel forms has been made by a large number of precast concrete products manufacturers. In North America alone, the investment represents many millions of dollars.

The jersey barrier forms are large, expensive, heavy steel molds that are designed to hold 8,000 pounds of concrete at a time. All present jersey barrier forms produce a barrier with a flat top as described above. Any modification of the jersey barrier forms requires the substantial expense of disassembly and rewelding. This is also a very time consuming process. Consequently, manufacturers are reluctant to make any changes to the forms.

The typical form is made from heavy steel plate that provides the finished profile of the barrier. The barrier is made using two types of forms, the upside-down type and the horizontal form, which is used for production of the half barrier.

In this upside-down type of form, the flat top is at the bottom of the form, and the base is at the top. The form is then filled with concrete in the same manner as making an "angel food" cake. Once the concrete is cured, the finished barrier is removed. The upside-down form can also be used to produce half barriers.

Recently, the use of half barriers has come into existence. A half jersey barrier has one completely flat vertical side. The half barrier can be formed in a horizontal mold or can be made in the upside-down type of form.

In this configuration, the half jersey barrier can be used as walls for structures which are used to contain contaminated or clean water. Other applications include using half jersey barriers for secondary containment around tanks and other structures which hold hazardous materials. In this application, plastic liners must be mechanically attached to the barriers using bolts and battens, usually to the flat face or the flat top of barriers, once the barriers have been set into place. Without the use of mechanical attachment to the barriers, the plastic liners would not stay in place.

Due to the success of the jersey barriers, numerous attempts have been made to improve them. The following are representative of the attempts. U.S. Pat. No. 5,453,916, issued to Tennis et al. on Sep. 26, 1995, discloses a modular safety lighting system that is designed specifically for jersey barriers. U. S. Pat. No. 5,443,324, issued to Sullivan on Aug. 22, 1995, discloses a pinning system for pinning one barrier to the next to provide a continuous barrier. U.S. Pat. No. 4,946,306, issued to Yodock on Aug. 7, 1990, discloses a plastic version of the jersey barrier.

Despite these efforts, concrete remains the sole choice for construction of jersey barriers and the design remains the same. While concrete is highly desirable from a number of perspectives, concrete is highly vulnerable to a wide range of chemical exposure. The ravages of road salt and pollution on bridges, sidewalks, and highways have clearly taken a toll. Repair to concrete or the replacement of concrete structures costs millions of dollars each year. The decay of such structures has reached crisis proportions in many parts of the country, particularly the northeast, where salt is used in the winter.

In an effort to utilize the low cost associated with concrete construction, yet protect the concrete from chemical attack, an extruded polymeric sheet has been used to clad the surface of the exposed concrete structure. Rather than attempting to mechanically fasten the plastic sheets using bolts and battens, as discussed above, regarding the half jersey barriers, plastic panels, known as "anchor sheets" in the trade, are installed during the forming process of the concrete structure by securing the anchor sheet to the concrete forms. Each anchor sheet has a plurality of T or X-shaped parallel ribs on the side of the sheet facing the concrete surface. The concrete, when poured and vibrated to eliminate voids, flows around the T-shaped ribs to lock the sheet firmly to the concrete. The sheets can then be welded at their seams forming a continuous liner that ensures that the concrete is isolated from the chemical exposures as well as normal weathering and aging.

Representative of this type of long term protection for concrete is the T-GRIP brand of anchor sheet as manufactured by Resicon, Inc. of 28 Central Street, Sunapee, N.H. The anchor sheets are available in pvc and low and high density polyethylene. Other plastics that are capable of being extruded could also be used. Anchor sheets have not been used to protect jersey barriers.

Therefore, there is not found in the prior art a method for securing anchor sheets to jersey barriers, which includes half barriers that does not require modification to the existing forms or that can be accomplished in a cost effective manner.

SUMMARY OF THE INVENTION

It is an aspect of the invention to provide a concrete barrier having a plastic cladding that can be used with standard jersey barrier forms, both the upside-down type and the horizontal type of form.

It is another aspect of the invention to provide a concrete barrier having a plastic cladding that can use standard anchor sheets to clad the barrier.

Another aspect of the invention is to provide a concrete barrier having a plastic cladding that is adaptable to either full or half size barriers.

Another aspect of the invention is to provide a concrete barrier having a plastic cladding that can be used with the jersey profile, either full or half.

It is still another aspect of the invention to provide a concrete barrier having a plastic cladding that prevents moisture and chemicals from reaching the concrete surface.

It is another aspect of the invention to provide a concrete barrier having a plastic cladding that can be used to make road barriers more attractive in addition to protecting the concrete from the elements.

Another aspect of the invention is to provide a concrete barrier having a plastic cladding that does not require the use of additional fasteners or labor to effect the attachment of the anchor sheet to the barrier.

It is another aspect of the invention to provide a concrete barrier having a plastic cladding that has a cap that can be reused so that the additional cost to produce the barrier is minimized.

It is still another aspect of the invention to provide a concrete barrier having a plastic cladding that has a permanent cap that is part of the barrier.

Other aspects and advantages of the present invention will become apparent and obvious from a study of the following description and the accompanying drawings which are merely illustrative of the invention.

The invention is a road barrier that is clad with a protective plastic sheet having a plurality of T or X shaped ribs to hold the sheet tightly to the concrete. A reusable cap is attached to the anchor sheet using Richardson anchors or plastic connectors well known in the art. The anchor sheet is firmly held against the cap to prevent concrete from flowing between the anchor sheet and cap. The anchor sheet and cap are placed in the upside-down type of form and the concrete is poured in. The concrete is prevented from flowing around the cap and behind it, as the cap has feathered edges that snugly fit within the form to provide a seal. The cap has a concave radius that corresponds to a radius to which the anchor sheet can easily conform. In the preferred embodiment, the cap is reusable so that after the concrete has set and the barrier with the attached anchor sheet is removed from the form, the cap can be detached and reused to make another barrier. In an alternative embodiment, the cap is left permanently in place to serve as further protection for the top of the barrier.

DETAILED DESCRIPTION OF THE INVENTION

The inventor has recognized that anchor sheets are the ideal way to protect jersey barriers. However, attachment of the anchor sheet cannot be accomplished using current fabrication techniques. Anchor sheets have not proved to be practical for use as protection for jersey barriers. If the anchor sheets were attached to one or both of the concave side surfaces or the flat vertical surface for the half jersey barrier, the flat top is of the barrier will allow moisture and chemicals dissolved therein to seep behind the anchor sheet. Under these circumstances, rather than protect the concrete, the deterioration of the concrete could actually be exacerbated. Further, moisture behind the sheet would freeze in cold temperatures, causing the concrete to spall.

The anchor sheet can not be continued onto the flat top to prevent moisture seepage behind the anchor sheet since it is quite stiff and cannot conform adequately to make the sharp bend required to go from the side to the flat top of the barrier. Providing a radius in the bottom (flat top) of the upside-down type of form requires the substantial expense of modification of the forms. However, even if a radius were provided in the upside-down type of barrier form, it would be impractical for a workman to secure the anchor sheet to the radius since the depth of a typical jersey barrier form is up to five feet. If the anchor sheet was not secured to the radius, then concrete would flow behind the sheet, destroying the appearance and functioning of the anchor sheet.

Figure 1:
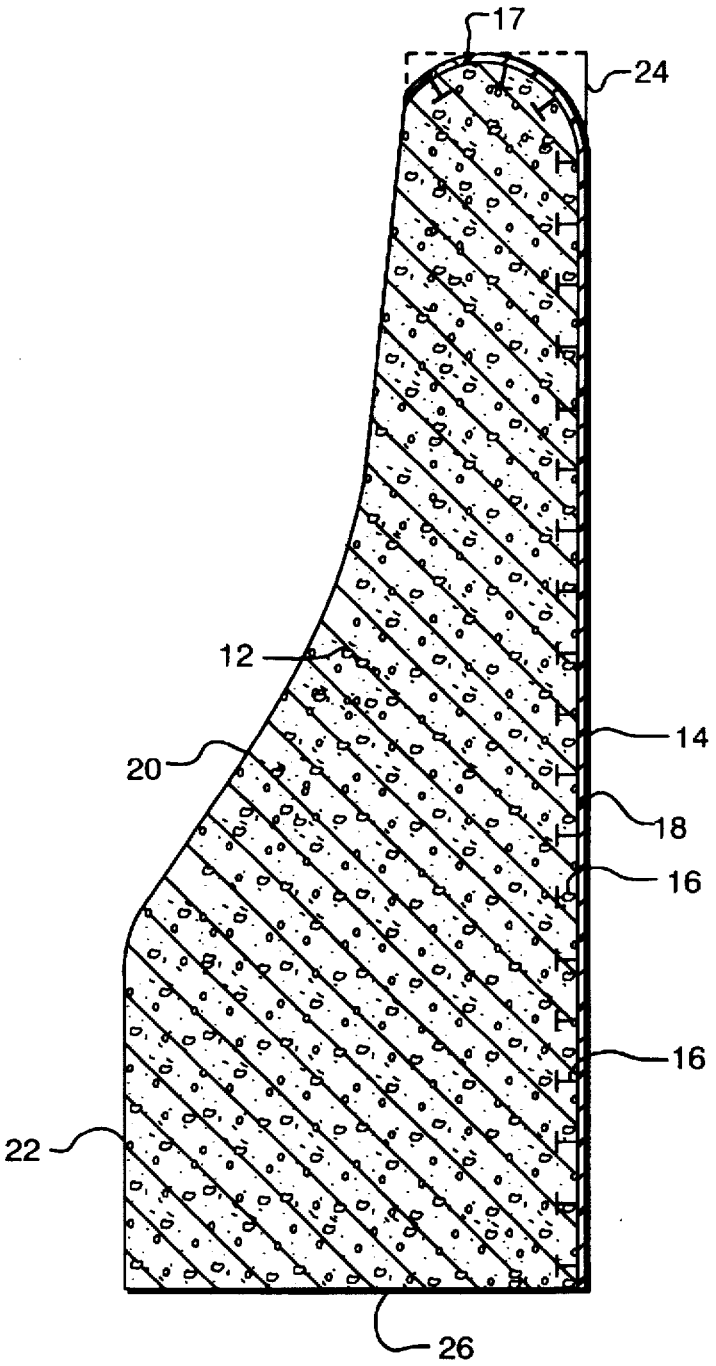
FIG. 1 is an end cross-sectional view of a half jersey barrier in accordance with the invention.

In order to prevent moisture from leaking behind the barrier and the attached anchor sheet, the anchor sheet 14 must cover the vertical face 18, over the top 17 and at least slightly down the concave side 20 as shown in FIG. 1.

If the barrier 12 conformed to the typical form, the top would follow line 24, thus having a substantially squared top. Anchor sheet 14 can not be bent to follow that sharp of bend but rather must follow the radius of top 17 as shown. Anchor sheet 14 is held rigidly to vertical face 18 via T-shaped ribs 16.

Note that an anchor sheet having X-shape ribs or another shaped protuberance, such that the hardened concrete will hold the plastic sheet tightly against vertical face 18 would also suffice. While it is expected that the invention will primarily be used with jersey type road barriers, other concrete barrier shapes could also be substituted. Further, the invention would be suitable for use for any concrete product that is produced in a mold where it proves desirable to cover one or more of the concrete surfaces with a plastic shield.

Figure 2:
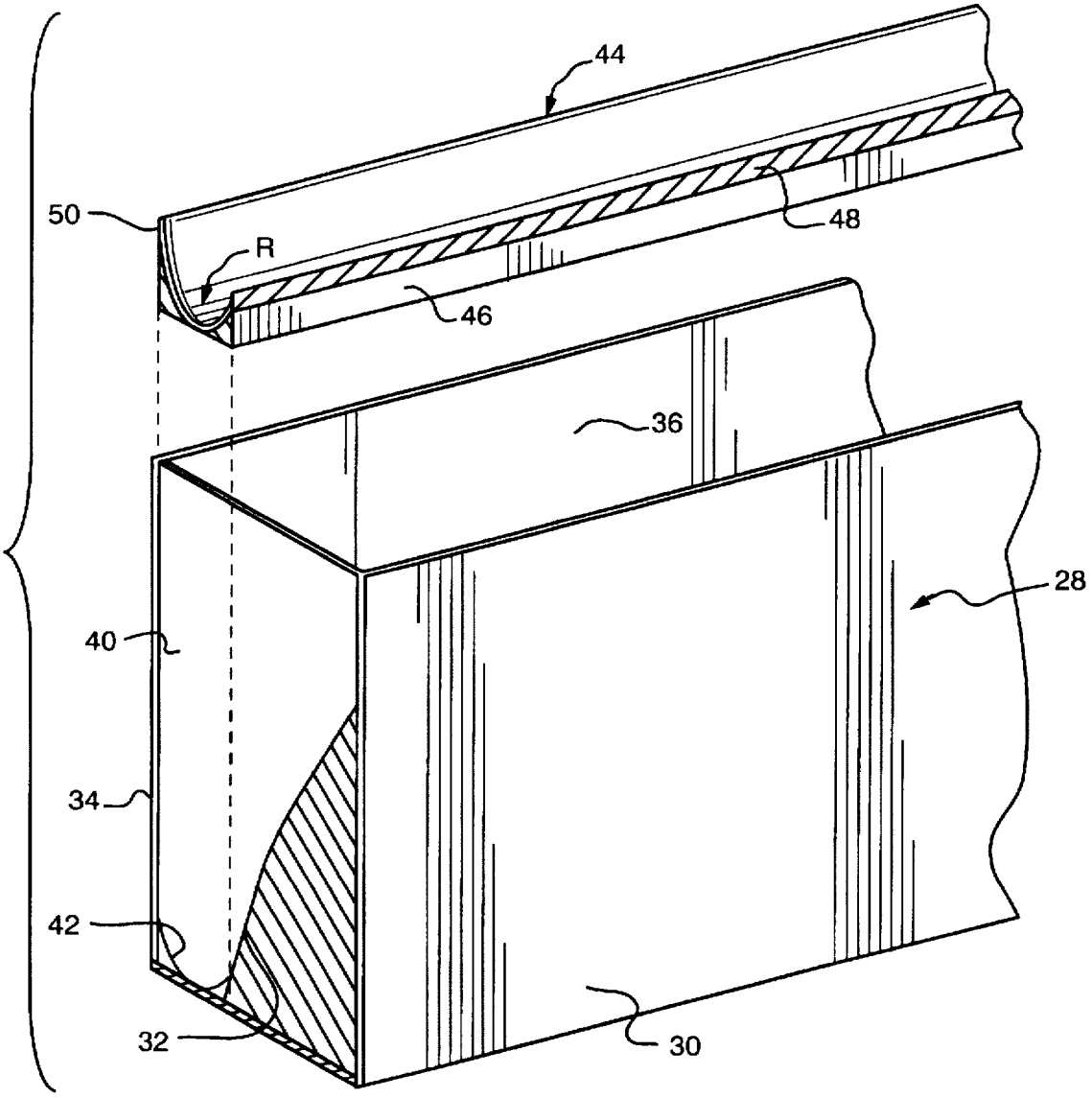
FIG. 2 is an isometric partial cut-away view of a half jersey barrier form and cap used to make the barrier of FIG. 1.

FIG. 2 is an isometric partial cut-away view of the half jersey barrier form assembly 28 that is used to make barrier 12. Assembly 28 is a typical example of an upside down type of form. As noted above, merely placing the appropriate radius in bottom 38 of form assembly 28 is not practical. Anchor sheet 14 must be held firmly in place while the concrete is being poured into opening 36 and cap used to make the barrier of FIG. 1. If anchor sheet 14 is not so held, concrete will be forced around anchor sheet 14 causing deformation of anchor sheet 14 and a ruined product.

Attempting to rigidly attach anchor sheet 14 temporarily to form assembly 28 at bottom 38 or concave steel insert 32 is not practical. The inventor has discovered that using cap assembly 44 enables the proper radius R to be achieved efficiently without the need to alter existing jersey barrier forms.

Cap assembly 44 is preferably fabricated from steel and is intended for reuse. Support platform 46 is shown as running continuously the entire length of assembly 44. However, that is not essential. Support platform 46 could consist of a number of discontinuous sections, provided that the weight of the concrete within the form did not deform radius R.

When set into form 28, cap assembly 44 is positioned so that feathered edge 48 is urged against concave steel insert 32 and feathered edge 50 is urged against vertical flat wall 34, thus ensuring that concrete will leak around cap assembly 44.

Figure 3:
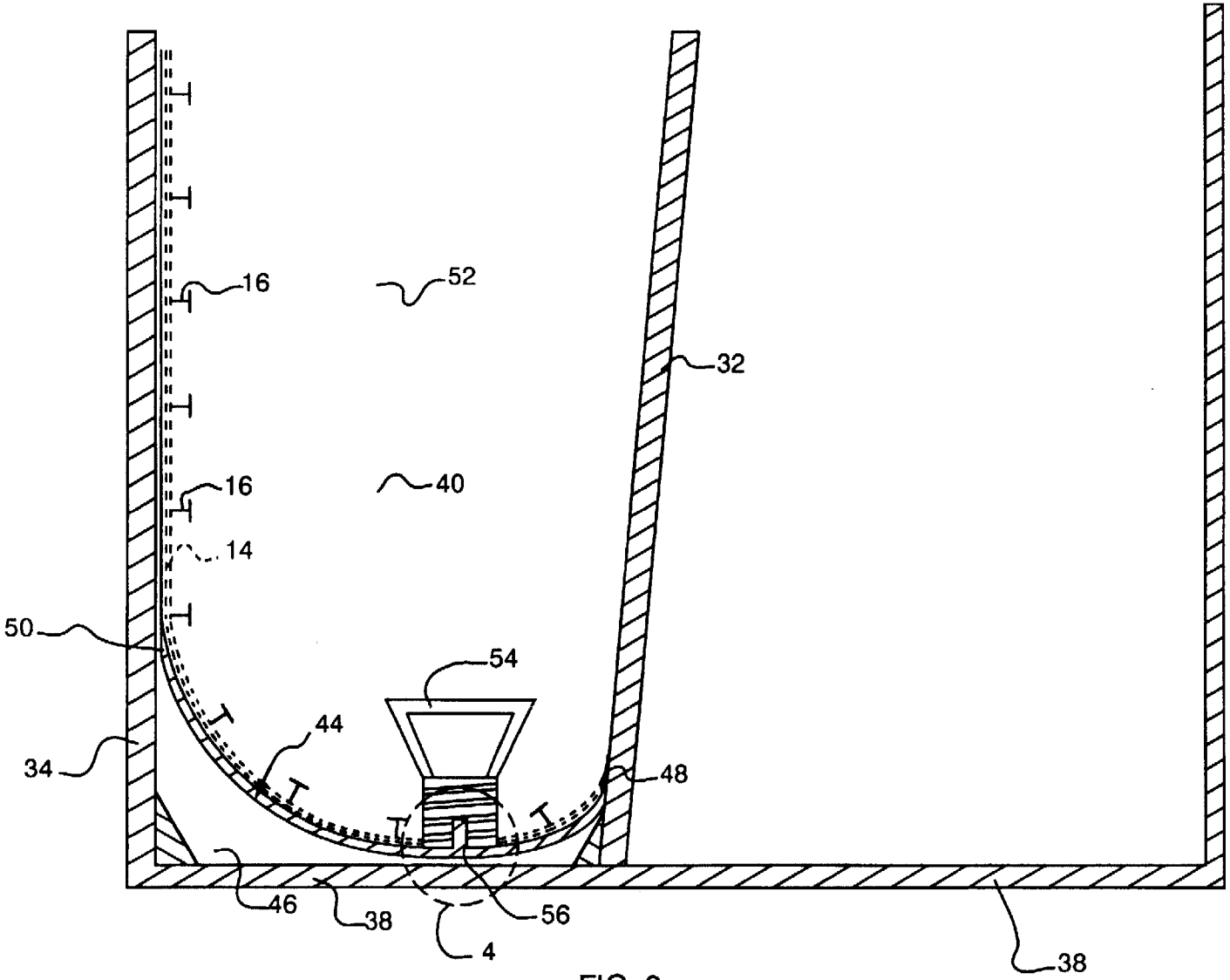
FIG. 3 is cross-sectional side view of the form shown in FIG. 2. with the cap in place.
Figure 4:
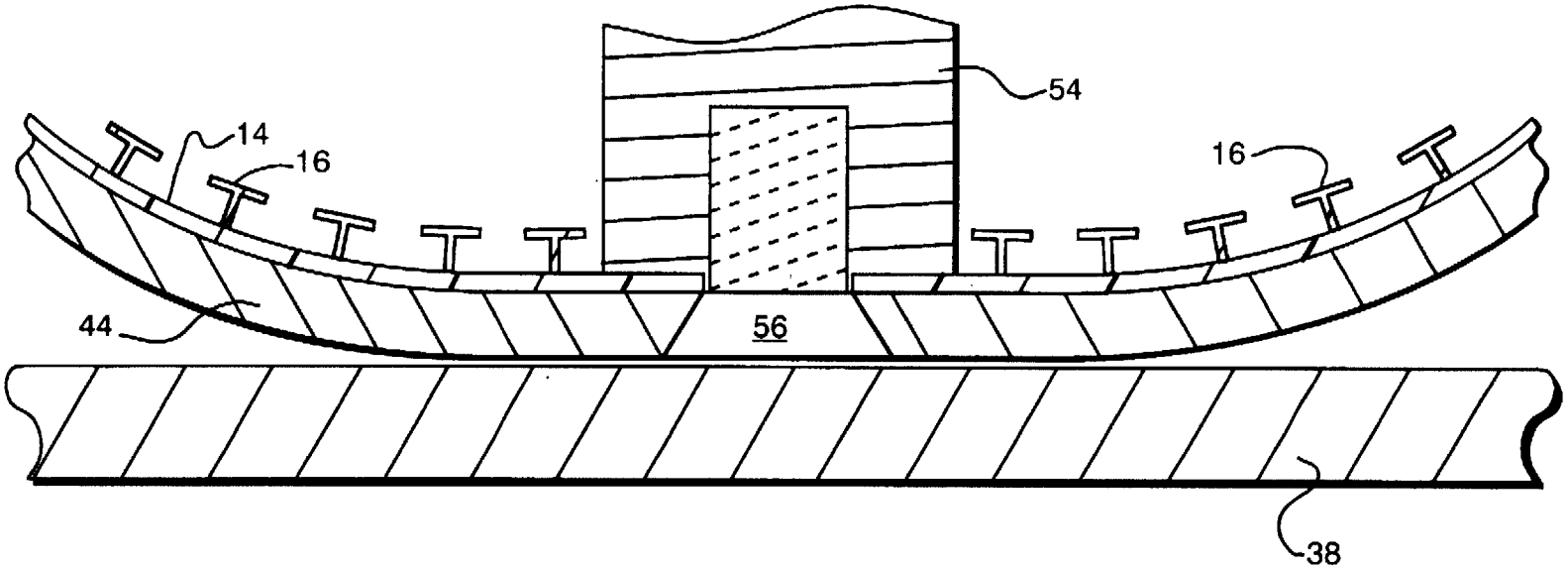
FIG. 4 is a detailed cross-sectional view of FIG. 3.

Referring now to FIGS. 3 and 4, cap assembly 44 is shown in place in form 28. To use cap assembly 44, anchor sheet 14 is attached to cap assembly via Richardson anchors 54 and screws 56 while cap assembly 44 is out of form 28. In this manner, the connections can be easily made without a worker having to attempt to reach into the form 28. Anchor sheet 14 is secured firmly against cap assembly 44 so that concrete 52 can not run between anchor sheet 14 and cap assembly 44.

Once anchor sheet 14 is secured to cap assembly 44, both are placed in form 28 as shown, again, noting that feathered edge 48 is tight against concave steel insert 32 and feathered edge 50 is tight against vertical flat wall 34. Support 46 rests against bottom plate 38, supporting cap assembly 44 against the weight of concrete 52 to keep radius R from deforming.

Richardson anchors 54 are customarily used in jersey barriers on the top edge so that the barrier can be easily lifted from site to site. Thus, other than reusable cap assembly 44 and anchor sheet 14, nothing additional must be purchased. However, for applications when Richardson anchors are not used, any suitable fastener, well known in the art, even plastic, could be used instead.

After the concrete is poured into form 28 and allowed to harden, half jersey barrier 12 having profile 40 is obtained with vertical wall section 18 and top 17 being clad with anchor sheet 14. After removal from form 28, screws 56 are removed, and cap assembly 44 can be disengaged to be used over and over again.

Anchor sheet 14 can be colored, printed upon or embossed, using techniques well known in the art, so that decorative barriers can be obtained. Anchor sheet 14 can be made from any plastic material that can be extruded. To provide an enclosed water tight structure, a number of barriers 12 can be linked together and the anchor sheets 14 welded to one another.

Figure 5:
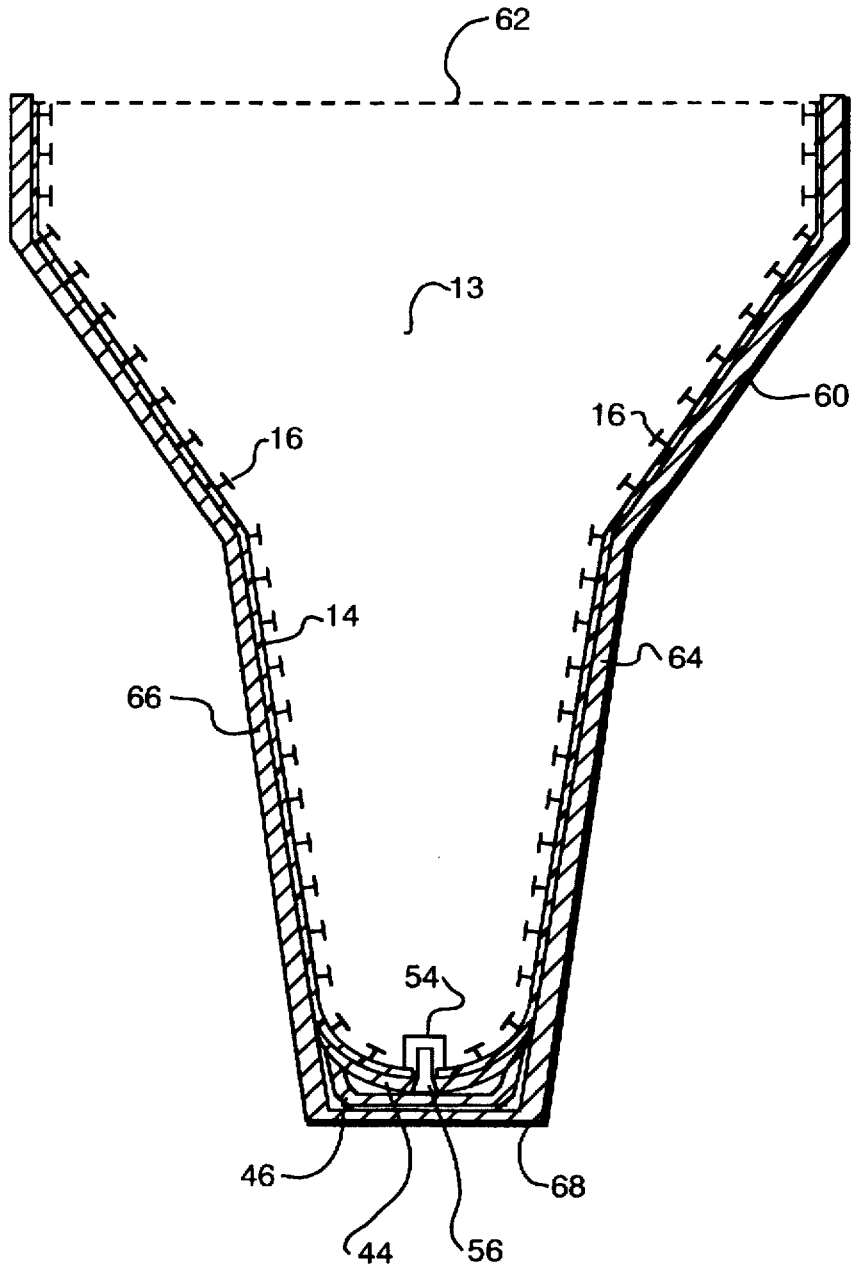
FIG. 5 is a cross-sectional side of a jersey barrier in its form in accordance with the invention.

To make a standard full sized jersey barrier, the process is essentially identical. Referring to FIG. 5, a full size jersey barrier 13 is shown. Form assembly 60 is fabricated from heavy steel plate having the profile as shown. Concrete fills form assembly 60 via open end 62. In this embodiment, anchor sheet 14 completely clads barrier 13. As before, T-shape ribs 16 ensure that plastic anchor sheet is firmly held against the concrete surfaces of barrier 13.

To manufacture barrier 13, cap assembly 44 is attached to anchor sheet 14 via Richardson anchors 54 or other suitable fasteners. Cap assembly 44 is provided with a radius that will enable anchor sheet 14 to intimate contact with entire surface of the form, including cap assembly 44. Then, cap assembly 44 and anchor sheet 14 is inserted in the form 60 with support 46 resting on bottom 68. As before, feathered edges on either end of cap assembly 44 contact left and right concave walls respectively. After the concrete has cured, the barrier 13 is removed from form 60. Screws 56 holding cap assembly 44 to anchor sheet 14 are removed and cap assembly 44 is stripped away so that it can be reused.

Figure 6:
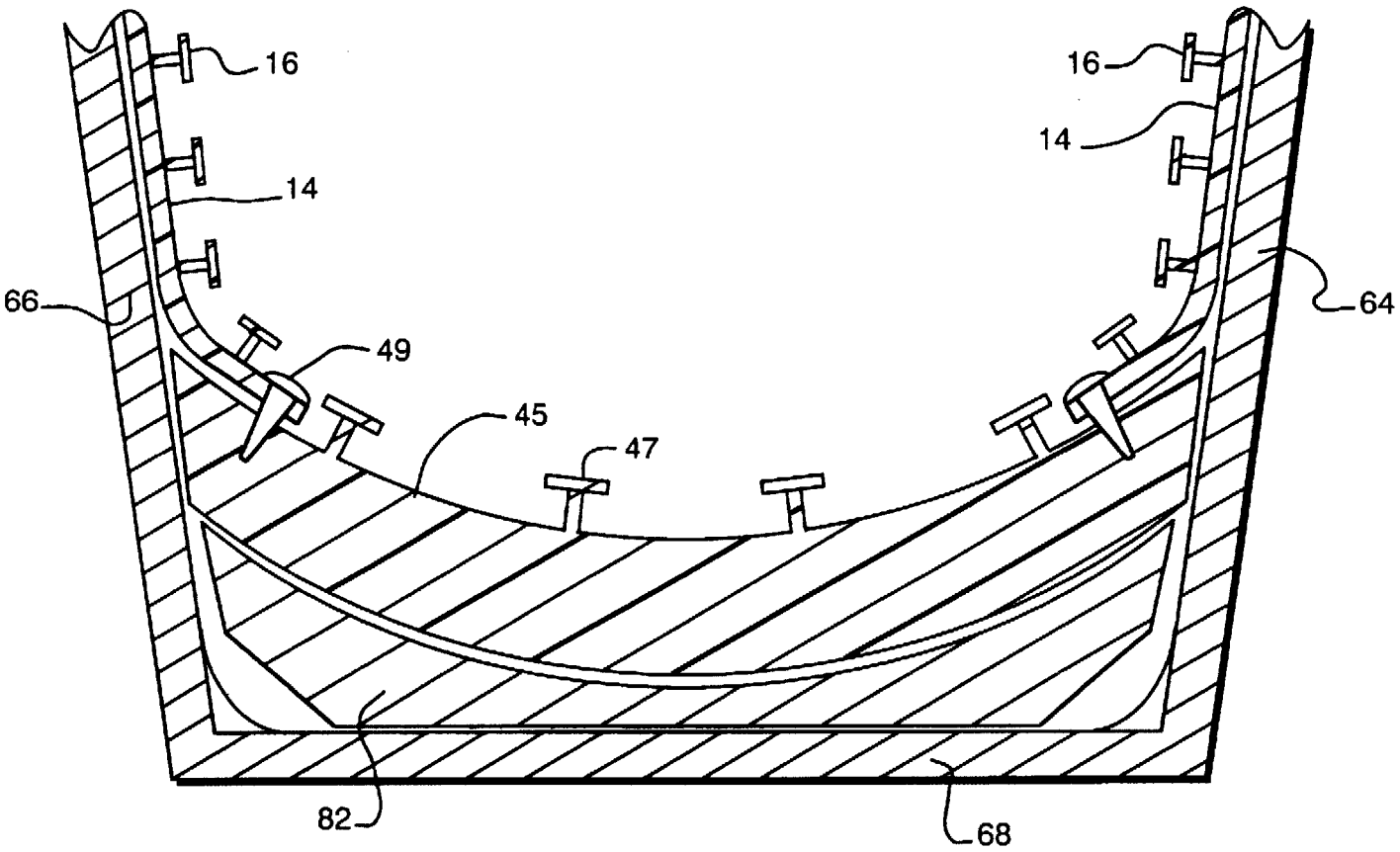
FIG. 6 is a detailed cross-sectional view of an alternative embodiment of the jersey barrier having an attached cap.

FIG. 6 is a detailed cross-sectional view of an alternative embodiment of the jersey barrier having a permanently attached cap 45. In this embodiment, cap assembly 44 has two separate parts: cap 45 and support 82. Cap 45 is preferably thick plastic such as used to manufacture anchor sheet 14. Cap 45 is provided with several rows of T-shaped ribs 47 so that cap 45 will be permanently and securely affixed to the concrete once it has cured. The barrier is made as before, except anchor sheet 14 is split into two sections, one section connected adjacent to the right edge of cap 45 via screws 49 and the other section connected adjacent to the left edge of cap 45, again by screws 49. Support 82 is placed in the form 60. Anchor sheets 14 which are fastened to cap 45 are then placed into form 60 and the form 60 is filled with concrete. As before, after the concrete has cured, the barrier 13 is removed, only cap 45 remains in place. If Richardson anchors 54 are to be used, openings (not shown) would be provided in cap 45 so that Richardson anchors could be fit through. As before, cap 45 could be made in a variety of colors and/or ornamental textures to make the resulting barrier more attractive.

This type of construction using either permanent cap 45 or reusable cap assembly 44 and anchor sheets 14 is suitable for manufacture of any precast concrete structure made in form, which has flat or curved surfaces, and, which need to be protected from chemical deterioration. Other applications could include decorative concrete panels for building construction, park benches, lawn ornaments, etc.

Figure 7:
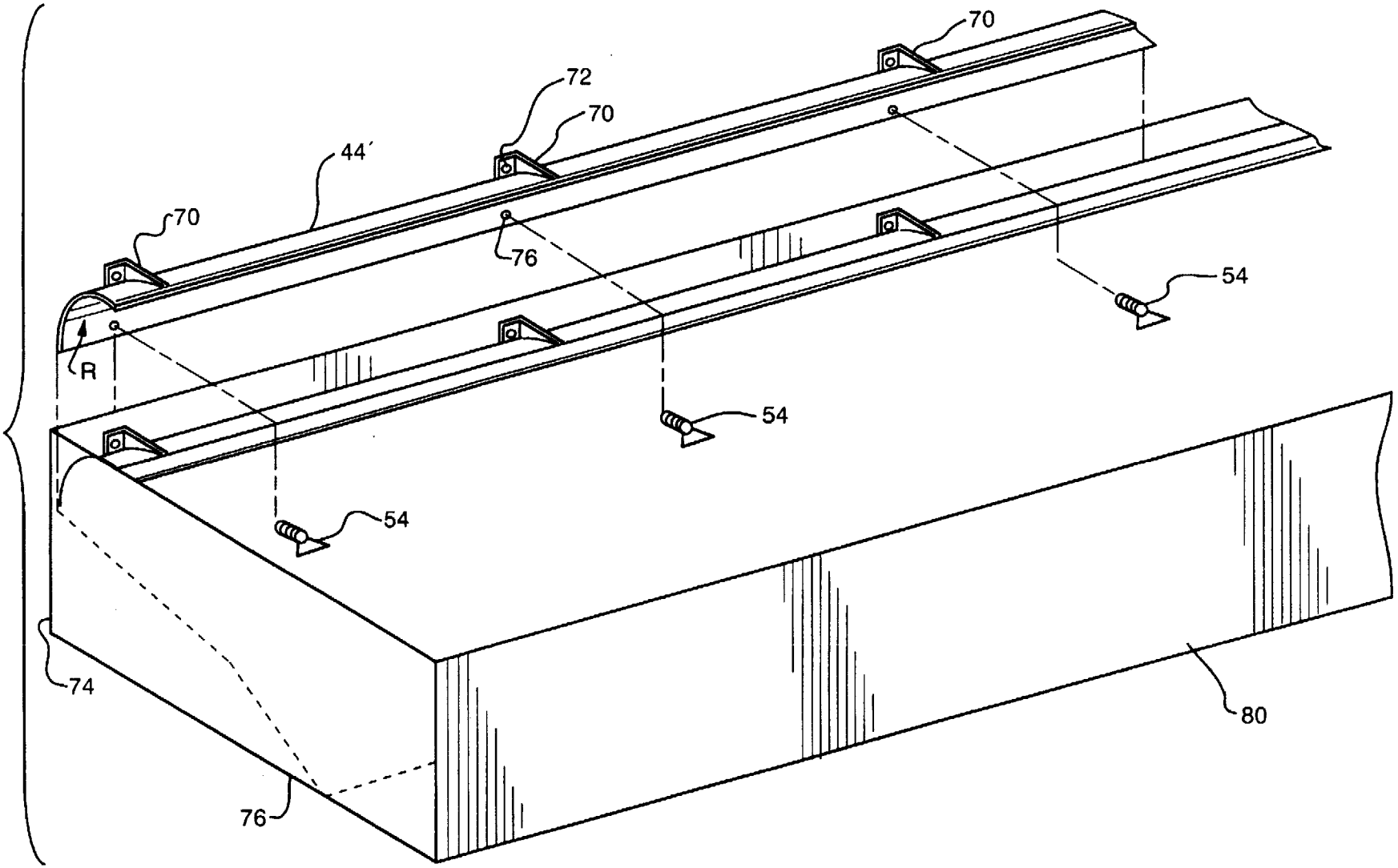
FIG. 7 is an isometric exploded view of a horizontal form used to make a half jersey barrier.

FIG. 7 is an isometric exploded view of a horizontal form 80 used to make a half jersey barrier 12. In this embodiment, cap assembly 44' is fitted with supports 70 which are provided approximately every 2 feet along the length of cap assembly 44'. Anchor sheet 14 is attached to cap assembly 44' as before using Richardson anchors 54 or plastic inserts. Then, cap assembly 44' and the attached anchor sheet 14 are fastened to form wall 74 via holes 72. Anchor sheet 14 is moved out of the way and concrete fills the form through the top 78. Then, anchor sheet 14 is placed down on top of the poured concrete and allowed to harden. Once cured, barrier 12 is removed from the form by removing fasteners that have been connected through holes 72 and cap assembly 44' is stripped away after the screws have been removed from Richardson anchors 54.

While there have been described what are at present considered to be the preferred embodiments of this invention, it will be obvious to those skilled in the art that various changes and modifications may be made therein without departing from the invention and it is, therefore, aimed to cover all such changes and modifications as fall within the true spirit and scope of the invention.

What is claimed is:

1. A concrete structure which is molded in a reusable form, said structure comprising:

an anchor sheet having a plurality of ribs, with each rib having a cross-sectional profile that will enable said rib to be held firmly within cured concrete, said anchor sheet having a bendable radius;

a reusable cap assembly having a radius that corresponds to the bendable radius of said anchor sheet, said cap assembly being releasably fastened to said anchor sheet via a plurality of fasteners, such that when said cap assembly and attached said anchor sheet are placed within the reusable form, which is then filled with wet concrete and allowed to cure to provide said concrete structure, and said concrete structure is removed from the reusable form and said cap assembly is released, said concrete structure will have at least one surface with a radius that is protected by said anchor sheet engaging said surface without any substantial voids between said anchor sheet and said surface.

2. The concrete structure of claim 1 wherein said fasteners are Richardson anchors.

3. The concrete structure of claim 1 wherein said form has a cross-sectional profile that corresponds to a jersey road barrier.

4. The concrete structure of claim 1 wherein said form is an upside-down type of steel form that has a profile corresponding to a jersey road barrier.

5. The concrete structure of claim 1 wherein said form is a horizontal type of steel form that has a profile corresponding to a half jersey road barrier.

6. The concrete structure of claim 1 wherein the cross-sectional profile of the ribs of said anchor sheet is T-shaped.

7. A concrete structure which is molded in a reusable form, said structure comprising:

an anchor sheet having a plurality of ribs, with each rib having a cross-sectional profile that will enable said rib to be held firmly within cured concrete, said anchor sheet having a bendable radius;

a permanent cap assembly having a plurality of ribs, with each rib having a cross-sectional profile that will enable said rib to be held firmly within cured concrete and having a radius that corresponds to the bendable radius of said anchor sheet, said cap assembly being fastened to said anchor sheet via a plurality of fasteners;

a reusable support assembly, such that when said support assembly is placed within said reusable form, and said cap assembly and attached said anchor sheet are rested on said support assembly within the reusable form, which is then filled with wet concrete and allowed to cure to provide said concrete structure, and said concrete structure is removed from the reusable form, said concrete structure will have at least one surface with a radius that is protected by said anchor sheet and said permanent cap engaging said surface without any substantial voids between said anchor sheet and said surface and without any substantial voids between said cap and said surface.

8. The concrete structure of claim 7 wherein said cap is plastic.

9. The concrete structure of claim 7 wherein said form has a cross-sectional profile that corresponds to a jersey road barrier.

10. The concrete structure of claim 7 wherein said form is an upside-down type of steel form that has a profile corresponding to a jersey road barrier.

11. The concrete structure of claim 7 wherein said form is a horizontal type of steel form that has a profile corresponding to a half jersey road barrier.

12. The concrete structure of claim 7 wherein the cross-sectional profile of the ribs of said anchor sheet are T-shaped.

13. The concrete structure of claim 7 wherein the cross-sectional profile of the ribs of said cap are T-shaped.

14. The concrete structure of claim 7 further comprising a second anchor sheet having a plurality of ribs, with each rib having a cross-sectional profile that will enable said rib to be held firmly within cured concrete, said anchor sheet having a bendable radius, wherein said second anchor sheet is substantially identical to said anchor sheet; said second anchor sheet also being attached to said cap assembly via a plurality of fasteners.

15. A concrete structure which is molded in a reusable form, said structure comprising:

an anchor sheet having a plurality of ribs, with each rib having a cross-sectional profile that will enable said rib to be held firmly within cured concrete, said anchor sheet having a bendable radius;

a radiused member attached to said form, with said radiused member having a radius that corresponds to the bendable radius of said anchor sheet, said anchor sheet being releasably fastened to said form on or adjacent to said radiused member via a plurality of fasteners, such that when said form is filled with wet concrete and allowed to cure to provide said concrete structure, and said concrete structure is removed from the reusable form and said anchor sheet is released, said concrete structure will have at least one surface with a radius that is protected by said anchor sheet engaging said surface without any substantial voids between said anchor sheet and said surface.

* * * * *